United States Patent [19]

De Sio

[11] Patent Number: 4,730,831

[45] Date of Patent: Mar. 15, 1988

[54] GAME WITH BOARD, PLAYING PIECES AND AWARD PIECES

[76] Inventor: Gina De Sio, 3979 N. Merrimac, Chicago, Ill. 60634

[21] Appl. No.: 844,602

[22] Filed: Mar. 27, 1986

[51] Int. Cl.[4] ..... A63F 3/00

[52] U.S. Cl. ..... 273/243; 273/290; 434/196; 434/127

[58] Field of Search ..... 273/243, 248, 249, 256, 273/278, 288, 289; 434/196, 127

[56] References Cited

U.S. PATENT DOCUMENTS 3,104,106 9/1963 Kenney et al. ..... 273/249
3,996,675 12/1976 Placek ..... 434/196
4,216,594 8/1980 Farley et al. ..... 273/249 X
4,273,337 6/1981 Carrera et al. ..... 273/243

*Primary Examiner*—Matthew L. Schneider
*Attorney, Agent, or Firm*—Paul H. Gallagher

[57] ABSTRACT

A playing board with paths thereon, each made up of a series of squares. Playing pieces are moved along the paths, and at certain locations are instructions for picking up award pieces, which are items making up a sandwich, including bread, ham and cheese, The award pieces are in whole slices, half slices, and quarter slices, for teaching a child. Educational clues are used for beginning the game, including mathematics clues, puzzle indicators, and general information answer indicators.

1 Claim, 20 Drawing Figures

GAME WITH BOARD, PLAYING PIECES AND AWARD PIECES

FIELD OF THE INVENTION

The invention resides in the general field of games that include a board and movable playing pieces. Such a game is played by several persons, in competition, each in turn moving his pieces along certain paths on the board, and following directions received at the beginning of a play, and at stopping places along the paths.

OBJECTS OF THE INVENTION

A broad object of the invention is to provide a game of the foregoing general character having the following features and advantages:

1. It is unusually attractive.
2. It has unusual educational qualities.
3. It is adaptable to make-up for use by those in many levels of learning, including slow learners, children, and virtually all older ages.
4. It includes a feature particularly for the slow learners, in the utilization of award pieces, some of fractional form that can be fitted together to teach what a whole item may be composed of.

DESCRIPTION OF A PREFERRED EMBODIMENT

In the drawings,

FIG. 4 is a stack of cards showing the blank side, containing mathematics expressions and formulas.

FIG. 5 is a face view of one of the cards of FIG. 4.

FIG. 6 is a face view of another of the cards of FIG. 4.

FIG. 7 is a stack of cards, showing the blank side, containing cryptic puzzle expressions.

FIG. 8 is face view of one of the cards of FIG. 7.

FIG. 9 is a face view of another of the cards of FIG. 7.

FIG. 10 is a stack of cards containing various questions to be answered.

FIG. 11 is a face view of one of the cards of FIG. 10.

FIG. 12 shows a stack of whole slices of bread.

FIG. 13 shows a stack of half slices of bread.

FIG. 14 shows a stack of quarter slices of bread.

FIG. 15 is a stack of whole slices of ham.

FIG. 16 is a stack of half slices of ham.

FIG. 17 is a stack of quarter slices of ham.

FIG. 18 is a stack of whole slices of cheese.

FIG. 19 is a stack of half slices of cheese.

FIG. 20 is a stack of quarter slices of cheese.

While the game of the invention is adaptable to various ages, the form represented herein finds most use for young children and the slow learning. In general, the kind of play involved in the game is to move playing pieces along certain paths on the board, and instructions are provided at locations along the paths for the players to utilize award pieces provided in the game.

The game includes what may be referred to as award pieces, constituting parts of a sandwich, including slices of bread, slices of ham, and slices of cheese. The time or length of the game is predetermined in the rules, such for example as when a complete sandwich is built up. An added feature of the game is that the award pieces, or food pieces, are provided in different forms, including whole slices, half slices, and quarter slices, and in the process of a player picking up these pieces, he learns the relative quantity of the various pieces, such as half slices, quarter slices, etc.

The game also includes means used in determining the order of playing, this means being generally of educational character. Specific examples of such are mathematics, cryptic puzzles, and general information.

Figure 1:
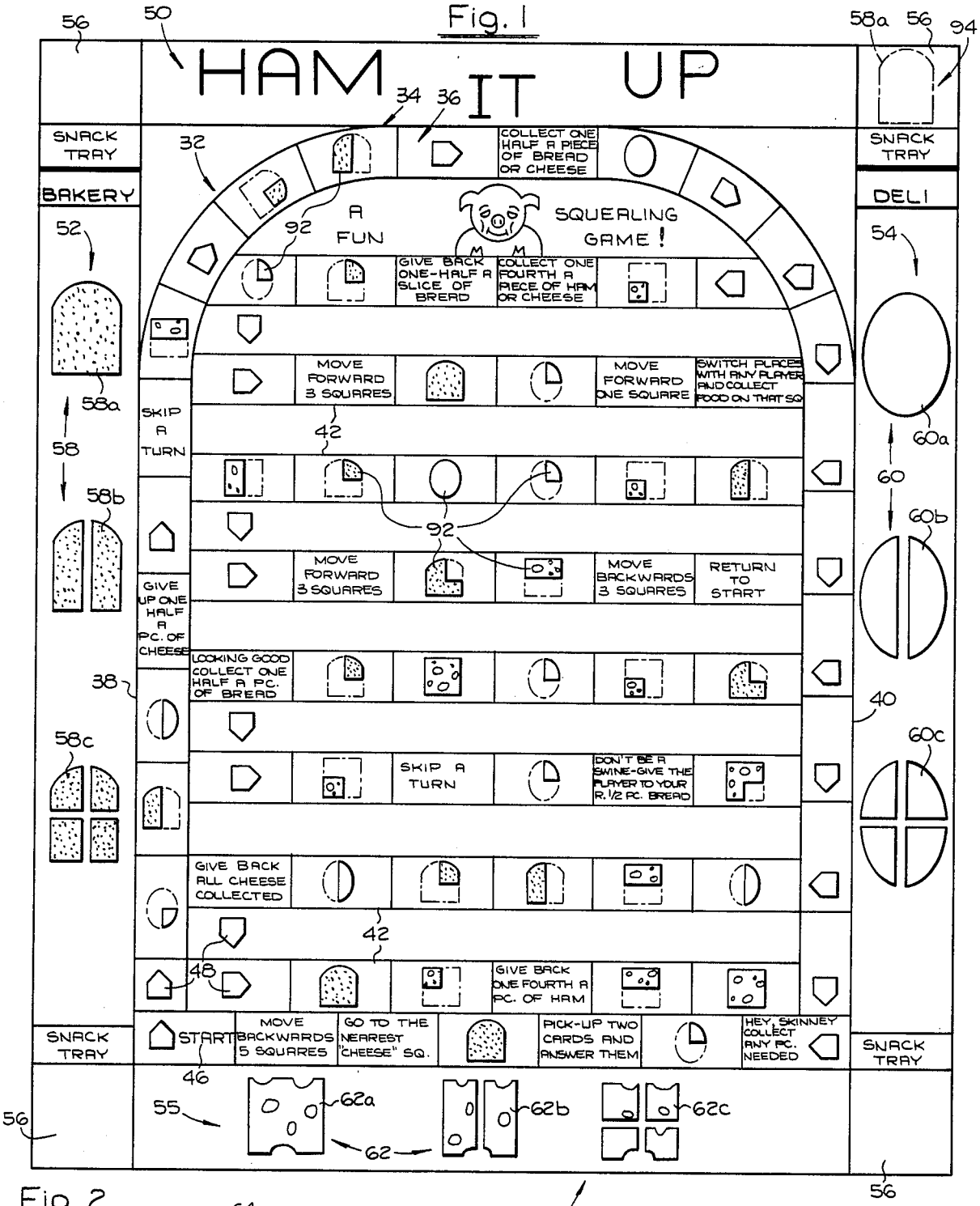
FIG. 1 is a face view of the board used in the game.

Referring to the drawings in detail, FIG. 1 shows the game board in face view. The board has imprinted thereon various markings, including paths for moving the playing pieces therealong, illustrations of various items including for example the award pieces, and instructions for additional steps, such as further steps in moving the pieces, and in utilizing the award pieces.

The board of the game, indicated in its entirety at 30, is provided on its face with various areas which are designated specially for convenience herein. The board includes a main area 32 which includes a plurality of paths, or portions thereof, indicated in the aggregate at 34 which include a main path 36, in this case of generally horseshoe shape, including legs 38, 40, and a plurality of cross paths 42 connected between the legs. Each path is made up of a plurality of squares, or locations, or stations 44, arranged successively and continuously along the length of the paths.

At a suitable starting point indicated at 46, and at various locations on the paths, are direction indicating arrows 48 for the player to follow in moving his playing pieces along the board.

In addition to the general playing area 32, is an area 50 at the top in which the title is inscribed, and other areas at the sides including a bakery area 52, a deli area 54, and another area 55 at the bottom used in this case for cheese. Additionally the board includes areas 56 at suitable locations, such as at corners, designated snack trays on which the award pieces, or pieces of food, are placed by the respective players in building up the sandwiches, which is one of the objects of the game.

As indicated above, the award pieces include pieces of food and in the bakery area 52 are illustrations of slices of bread in different forms. These slices of bread are indicated generally at 58 and include a full slice **58*a*, another slice cut in halves 58*b*, and a slice cut in quarter slices 58*c***.

In referring to the food items hereinbelow, reference is made to full slices, half slices, and quarter slices, and this reference is relative to what is generally recognized by those expressions, but it is of course not intended that the slices or pieces be of any certain size since the bulk from which slices are cut would vary in size, but only what is recognized as a full slice, and a partial slice, from the standpoint of a person learning from the game.

In the deli space 54 are illustrated pieces of ham 60, including a full slice **60*a*, another slice cut in halves forming two half slices 60*b*, and a slice cut into quarter slices 60*c***.

In a similar arrangement, there is illustrated in the space 55, pieces of cheese 62, including a full slice **62*a*, another slice cut in half slices 62***b*, and a slice cut into quarter slices 62*c*.

In FIG. 1, the representations 58, 60, 62 are imprinted on the board, and are made up to appear as the intended genuine article, namely bread, ham, cheese. The items illustrated in FIGS. 12–20 are placed in stacks on these respective illustrations in the areas 52, 54, 55, and removed therefrom individually according to the instructions in playing the game, as referred to again hereinbelow.

Figure 2:
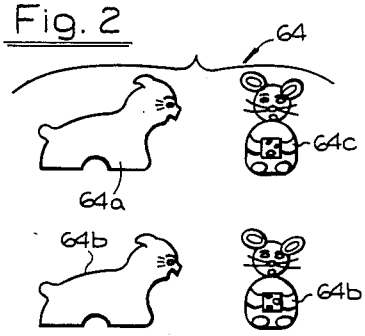
FIG. 2 shows the playing pieces to be moved along the board.

FIG. 2 shows playing pieces 64, which are individually identified 64*a*, 64*b*, 64*c*, 64*d*, and are preferably three dimensional animal pieces, such as pigs, mice, etc. In playing the game, the individual players pick out one of the playing pieces, and use it in moving along the paths on the board.

Figure 3:
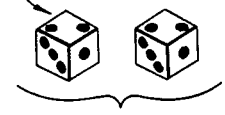
FIG. 3 shows a pair of dice utilized in starting the game.

For determining the first player, or the player who has a first choice at playing, a pair of dice 66 (FIG. 3) may be utilized, a roll of the dice indicating such beginning.

Figure 4:
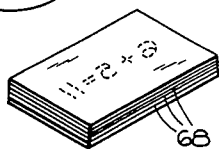
FIGS. 4–11 illustrate items used in determining the order of playing by the players.
Figure 5:
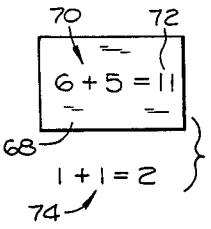
Figure 6:
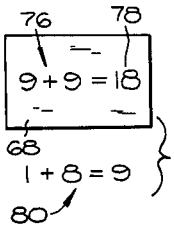

Another method may be used for determining the first player; each player selects one of the cards 68 shown in FIGS. 4–6. These cards constitute a mathematics phase of the educational aspect, and each includes a mathematics formula as shown in FIGS. 5 and 6. The formula in FIG. 5, indicated at 70 is an addition problem, including the sum 11 indicated at 72. In playing the game, it is desired that all numbers of indicating starting turns be of only one digit, and in the case where the sum is 11, the two digits of that sum, namely 1 plus 1, total 2 as indicated at 74. Similarly in FIG. 6, the mathematics formula 76 has a sum 18 as indicated at 78. The two digits of this sum are added together to form the digit 9. The order of playing may be for example, the highest digit first, then in descending order.

Figure 7:
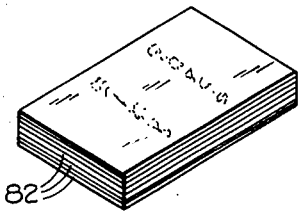
Figure 8:
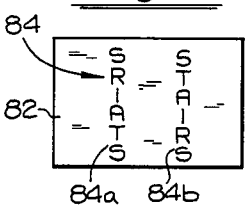
Figure 9:
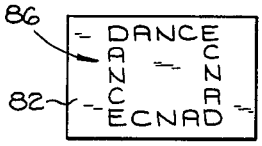

Alternate methods of determining the order of play are indicated by the items of FIGS. 7–9 and 10–11. In FIGS. 7–9 is illustrated a stack of cards 82 with the blank side showing. These cards include inscriptions 84, 86, which form cryptic puzzles. For example, in FIG. 8 the letters shown in each of the two cases spell STAIRS but are arranged oppositely. At 84*a* the word is spelled correctly proceeding upwardly and at 84*b* downwardly, the first 84*a* then representing UPSTAIRS, and the second 84*b* DOWNSTAIRS.

In FIG. 9, the inscription 86 includes the word DANCE arranged in a square, and the answer expected is SQUARE DANCE. The use of the cards 82 in FIGS. 7–9 is similar to that of the crads of FIG. 4–6.

Figure 10:
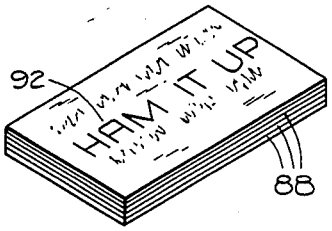
Figure 11:
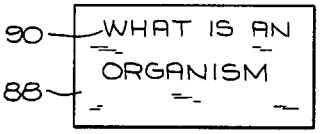
Figure 12:
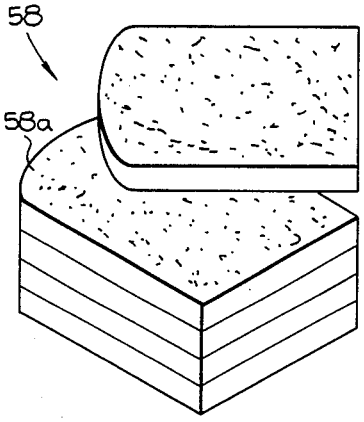
FIGS. 12–20 show award pieces used in the game, these being synthetic items of food.
Figure 13:
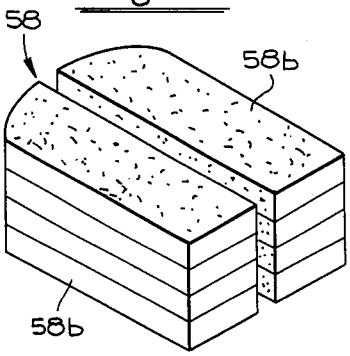
Figure 14:
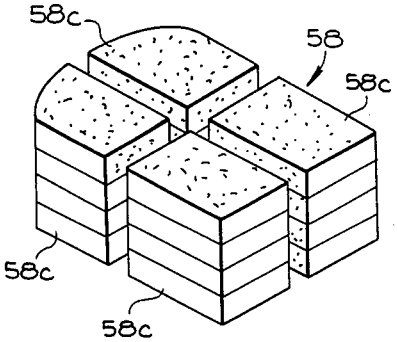
Figure 15:
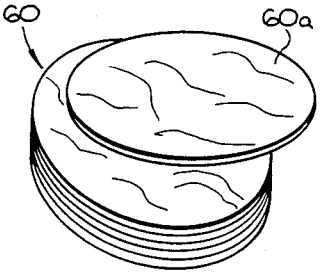
Figure 16:
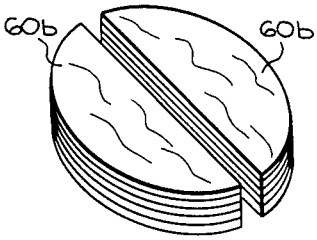
Figure 17:
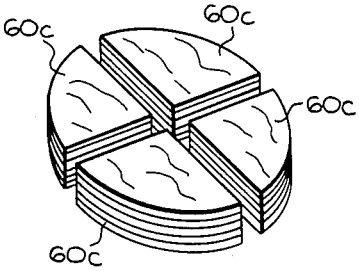
Figure 18:
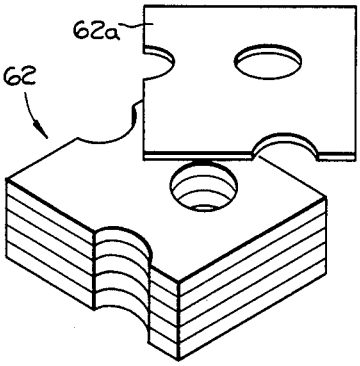
Figure 19:
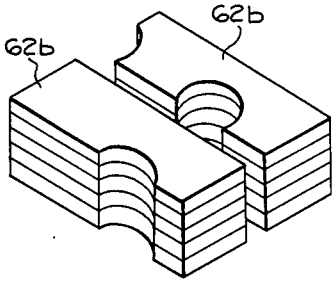
Figure 20:
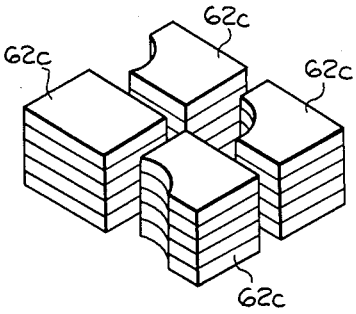

FIGS. 10–11 show additional cards 88, in this case also bearing on their front side the questions 90 (FIG. 11) and on the reverse side any suitable inscription 92 such as the name of the game.

In beginning the play, the physical or three dimensional pieces of food represented in FIGS. 12–20 are placed on the respective areas 58, 60, 62, according to whether they are full slices, half slices, or quarter slices. Then the game is proceeded with as referred to above and the first player places his playing piece 64 at the start position 46 (FIG. 1 lower left). The first player then moves along the path, i.e. along the leg 38 thereof, the number of squares or locations indicated by the dice or the card 68 (FIGS. 4–6) he selected, etc. He then moves the piece up that number of squares and follows the instructions encountered in the square to which he has advanced. These instructions are of various kinds including representations 92 pictorially representing the items of food, namely the bread, the ham, and the cheese. These pieces further are designated according to whether they are full slices, half slices, and quarter slices, and as each player encounters these representations, he picks up the corresponding pieces at the areas 52, 54, 55, and places them in his own snack tray area 56, as indicated at 94. As one goal in the game, as a sandwich is completed, the game is won. Other goals may be a double decker, a triple decker, a ham only, a cheese only, etc., sandwich.

The items illustrated respectively in FIGS. 4–6, FIGS. 7–9, and FIGS. 10–11 may be utilized together, or individually in any particular game. The manner of selecting the first player, and the order of playing, may be determined by rules other than those described, within the scope of the invention.

The game provides educational training in mathematics phase (FIGS. 4–6), in calculating the digit to be used in determining the order of play, and the aspect represented in FIGS. 7–9 provides training in observing incomplete, or cryptic messages, while the items of FIGS. 10–11 provide training or recollection in general information or intelligence. Additionally the provision of the slices of food, including both the whole slices and partial slices, provide training or practice for the player in determining what part of the whole the partial pieces represent, such as for example the number of quarter slices making up a whole or a combination of half slices and quarter slices, making up such whole slice.

The game as a physical device or kit, includes the board and the various other items referred to above, but particularly in the caes of food items 58, 60, 62, these are three dimensional pieces made of such material as cardboard, felt, cloth, etc. that appear readily recognizable as the corresponding pieces, but that may be handled repeatedly without noticeable deterioration.

I claim:

1. A game to be played by a plurality of players in competition, comprising, a board having a plurality of paths indicated thereon, and each path including a plurality of squares with instructions as to steps to be performed by a player, a playing piece for each player for placing on and moving along the paths, a plurality of award pieces certain ones of which constitute a part of, but less than, a complete object, and adapted to be fitted together and thereby capable of constituting a recognizable greater part of the object, the award pieces also including complete objects, and the part pieces including so many as to be capable of forming complete objects, the complete objects being capable of being fitted together to form recognized compound objects, the compound objects being sandwiches, the complete objects being parts that make up a sandwich including bread pieces and filler pieces, and the part pieces being of smaller size than, and constituting portions of, sandwich parts of predetermined shape and size.

* * * * *